US005983449A

United States Patent [19]

Thomas et al.

[11] Patent Number: 5,983,449

[45] Date of Patent: Nov. 16, 1999

[54] DIRT CONVEYING DUCT ARRANGEMENT

[75] Inventors: Kevin L. Thomas, North Canton; Edgar A. Maurer, Canton, both of Ohio

[73] Assignee: The Hoover Company, North Canton, Ohio

[21] Appl. No.: 09/078,148

[22] Filed: May 13, 1998

[51] Int. Cl.[6] ..... A47L 5/30

[52] U.S. Cl. ..... 15/383; 15/334; 15/337; 15/351

[58] Field of Search ..... 15/327.7, 331, 15/334, 337, 338, 349, 350, 351, 383, 352

[56] References Cited

U.S. PATENT DOCUMENTS

| | | | |
|---|---|---|---|
| 4,219,900 | 9/1980 | Dyer | 15/339 |
| 4,384,385 | 5/1983 | Maurer | 15/339 |
| 4,811,450 | 3/1989 | Steadings | 15/337 |
| 5,351,361 | 10/1994 | Buchtel | 15/334 |
| 5,383,252 | 1/1995 | Hampton et al. | 15/325 |
| 5,414,893 | 5/1995 | Hampton et al. | 15/412 |
| 5,551,120 | 9/1996 | Cipolla et al. | 15/333 |
| 5,560,074 | 10/1996 | Graham et al. | 15/323 |

FOREIGN PATENT DOCUMENTS 2043432 2/1980 United Kingdom .

OTHER PUBLICATIONS

Photograph of Hoover Power Drive Vacuum Cleaner (side view of duct)—Duct Introduced~May 1992.

Photograph of Hoover Power Drive Vacuum Cleaner (bottom view of duct)—Duct Introduced~May 1992.

*Primary Examiner*—William H. Beisner

*Attorney, Agent, or Firm*—A. Burgess Lowe; Thomas R. Kingsbury

[57] ABSTRACT

A dirt conveying duct arrangement is formed between a nozzle and motor-fan of a vacuum cleaner and includes front and rear duct sections. The front duct section is open at the bottom thereof and covered by a removable bottom plate. The rear duct section is open at the top thereof and is covered by a removable top duct cover. The two-section dirt conveying duct arrangement allows clogs to be removed along the entire length thereof. The corner formed between the rear duct section and the motor-fan inlet may be molded with a radius to improve airflow into the motor-fan and limit losses in suction pressure.

20 Claims, 7 Drawing Sheets

DIRT CONVEYING DUCT ARRANGEMENT

BACKGROUND OF THE INVENTION

1. Technical Field

The invention relates to vacuum cleaners. Particularly, the invention relates to a dirt conveying duct arrangement for vacuum cleaners. More particularly, the invention relates to a dirt conveying duct having a front duct section open at the bottom thereof and covered by a removable bottom plate, and a rear duct section open at the top thereof and covered by a removable top duct cover.

2. Background Information

Dirt clogging of vacuum cleaners has long been a problem in the floor care art. Dirt-laden air is loosened from the floor by a cylindrical agitator and is drawn into a dirt conveying duct by a suction force produced by a motor-fan. The dirt-laden air travels through the dirt conveying duct into a motor-fan inlet of the motor-fan and is blown into a filter bag which filters the small dirt particles from the airflow. The exhaust air from the filter bag is emitted into the atmosphere. Although a clog may occur anywhere between the suction nozzle mouth and to and within the bag itself, typically these clogs occur in the dirt conveying duct between the agitator chamber and the motor-fan inlet.

Conventional vacuum cleaners include dirt conveying ducts formed with an open bottom. The open bottom is covered by the removable bottom plate which also covers the agitator chamber and belt compartment. One problem with the dirt conveying ducts of conventional vacuum cleaners is that the duct extends transversely along the foot of the vacuum cleaner while the motor-fan and agitator chamber extend longitudinally across the foot of the vacuum cleaner. Thus, the dirt-laden air drawn into the nozzle and dirt conveying duct must turn at a 90 degree angle into the motor-fan inlet where it is then blown into the filter bag. It is well known in the art of airflow that a 90 degree corner causes losses in the suction pressure and reduces the airflow velocity, thus reducing the efficiency of the vacuum cleaner.

By forming the rear of the duct with an open top, the corner between the dirt conveying duct and the motor-fan inlet may be radiused or curved to improve airflow between the duct and the motor-fan, thus increasing the suction pressure, airflow velocity and overall efficiency of the vacuum cleaner. A front duct section is open at the bottom thereof allowing for easy removal of clogs in the front of the dirt conveying duct arrangement. By forming the front of the duct with an open bottom, clogs which may occur in the front duct section may be easily accessed by removal of the bottom plate preventing time consuming disassembly of the hood and top duct cover. Further, the open front duct section provides visibility to the rear duct section allowing the user to check the rear duct section for clogs before disassembling the hood and top duct cover to gain access to the rear duct section.

Several vacuum cleaners mold the base in such a manner that corner of the duct adjacent the motor fan inlet may be radiused. For example, U.S. Pat. No. 5,383,252 discloses a suction channel molded in the nozzle and formed by integral bottom and side walls. The suction channel has an open top end which allows the motor-fan inlet to be formed with a radiused edge. A top panel is permanently attached to the upper surface of the side walls by ultrasonic welding or other equivalent process. However, after the top panel has been ultrasonically welded over the top of the duct, the user cannot easily access clogs which may occur at the rear of the dirt conveying duct.

U.S. Pat. No. 4,384,385 discloses a duct having an open top portion along the entire length of the duct and covered by a duct cap which is removably secured over the open top. A circular opening is formed in the side walls of the duct opposite the motor-fan inlet and provides access to the duct for removal of the dirt or debris retained therein. A removable stopper cap covers the dirt removal opening of the duct during operation of the vacuum cleaner.

Several other patents disclose dirt conveying ducts which allow provide for easy removal clogs. For example, U.S. Pat. No. 4,219,900 discloses a pivoting nozzle duct which is pivotally connected to the motor-fan inlet. The duct is a generally L-shaped tubular member which provides fluid communication between the agitator chamber and the motor-fan. The duct pivots out of the housing providing access thereto for de-clogging and cleaning thereof.

U.K. Patent Application GB 2043432-A discloses an air duct formed with a neck having an open front end which communicates with the agitator chamber, an enlarged rear chamber which provides communication between the neck and the motor-fan inlet and a bottom well. The bottom well is formed below the enlarged rear chamber and allows heavier objects which are picked up by the vacuum cleaner to fall therein, preventing these heavier objects from being sucked into the motor-fan inlet possibly damaging the fan blade. A hole is formed in the bottom wall of the cleaner foot for removing the heavy objects contained within the well.

Although these devices are adequate for the purposes for which they are intended, they do not disclose a two section dirt conveying duct which allows the corner between the rear duct section and the motor fan inlet to be radiused and which provides an open bottom for easy removal of clogs therefrom while providing visibility to the rear duct section allowing for the inspection of clogs therein.

Therefore, the need exists for a dirt conveying duct arrangement which has a front duct section open at the bottom thereof which allows for removal of clogs therein and which provides visibility to the rear duct section, and in which the rear duct section is open at the top thereof which allows a radiused corner to be formed between the duct and the motor-fan.

SUMMARY OF THE INVENTION

Objectives of the invention include providing an improved dirt conveying duct arrangement which allows for access along the entire length thereof for the removal of clogs therein.

A further objective of the invention is to provide such an arrangement in which the duct is formed in two sections: a front duct section open at the bottom thereof, and a rear duct section open at the top thereof.

A still further objective of the invention is to provide such an arrangement in which the open bottom of the front duct section is covered by a removable bottom plate; in which the open top of the rear duct section is covered by a removable top duct cover.

Another objective of the invention is to provide such an arrangement which provides for visibility to the rear duct section through the open bottom of the front duct section.

A further objective of the invention is to provide such an arrangement which allows a radiused corner to be formed between the dirt conveying duct and the motor-fan inlet.

These objectives and advantages are obtained by the dirt conveying duct arrangement of the present invention, the general nature of which may be stated as including . . . claim 1.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
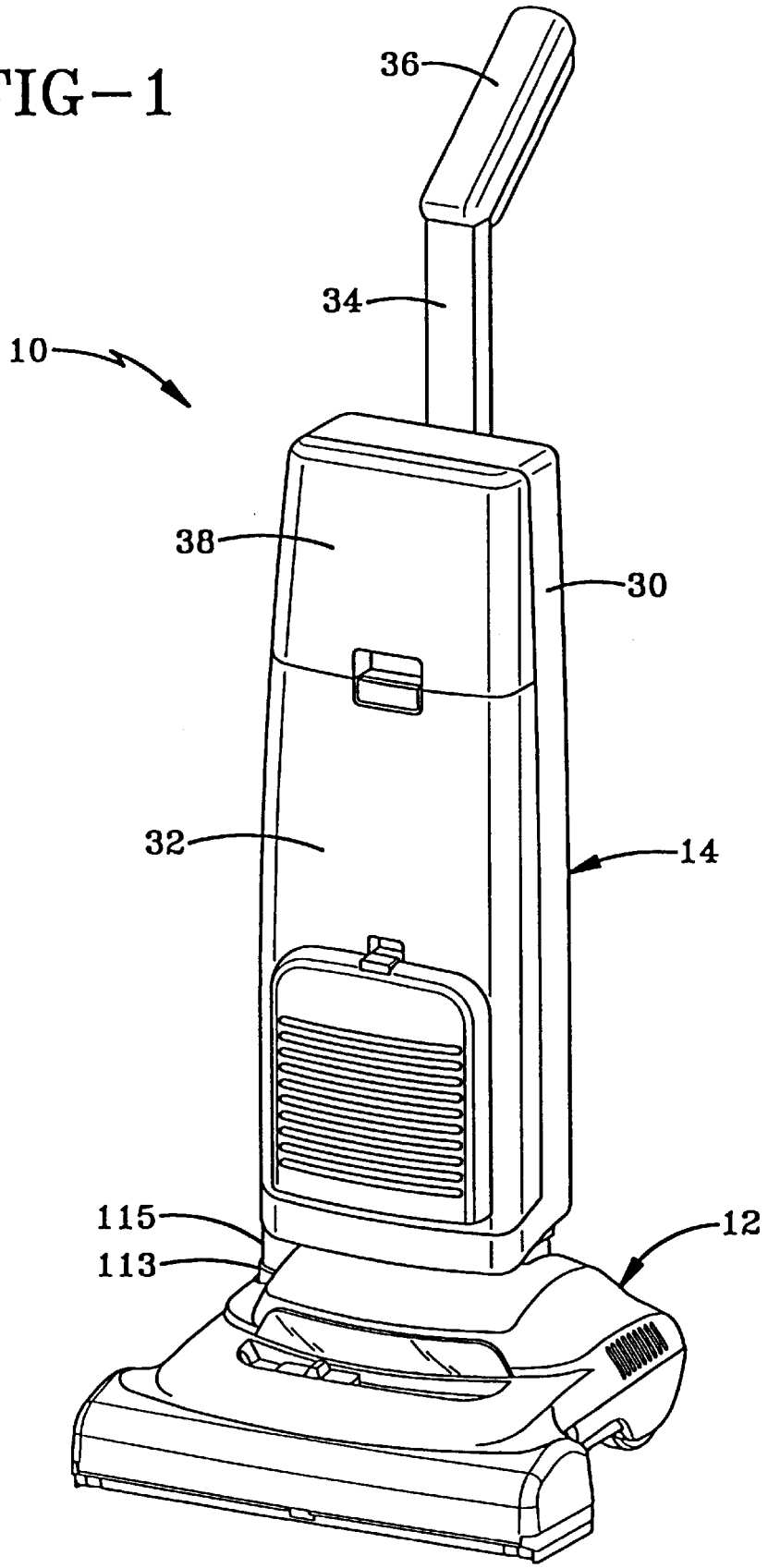
FIG. 1 is a perspective view of a vacuum cleaner having the dirt conveying duct arrangement of the present invention incorporated therein.
Figure 2:
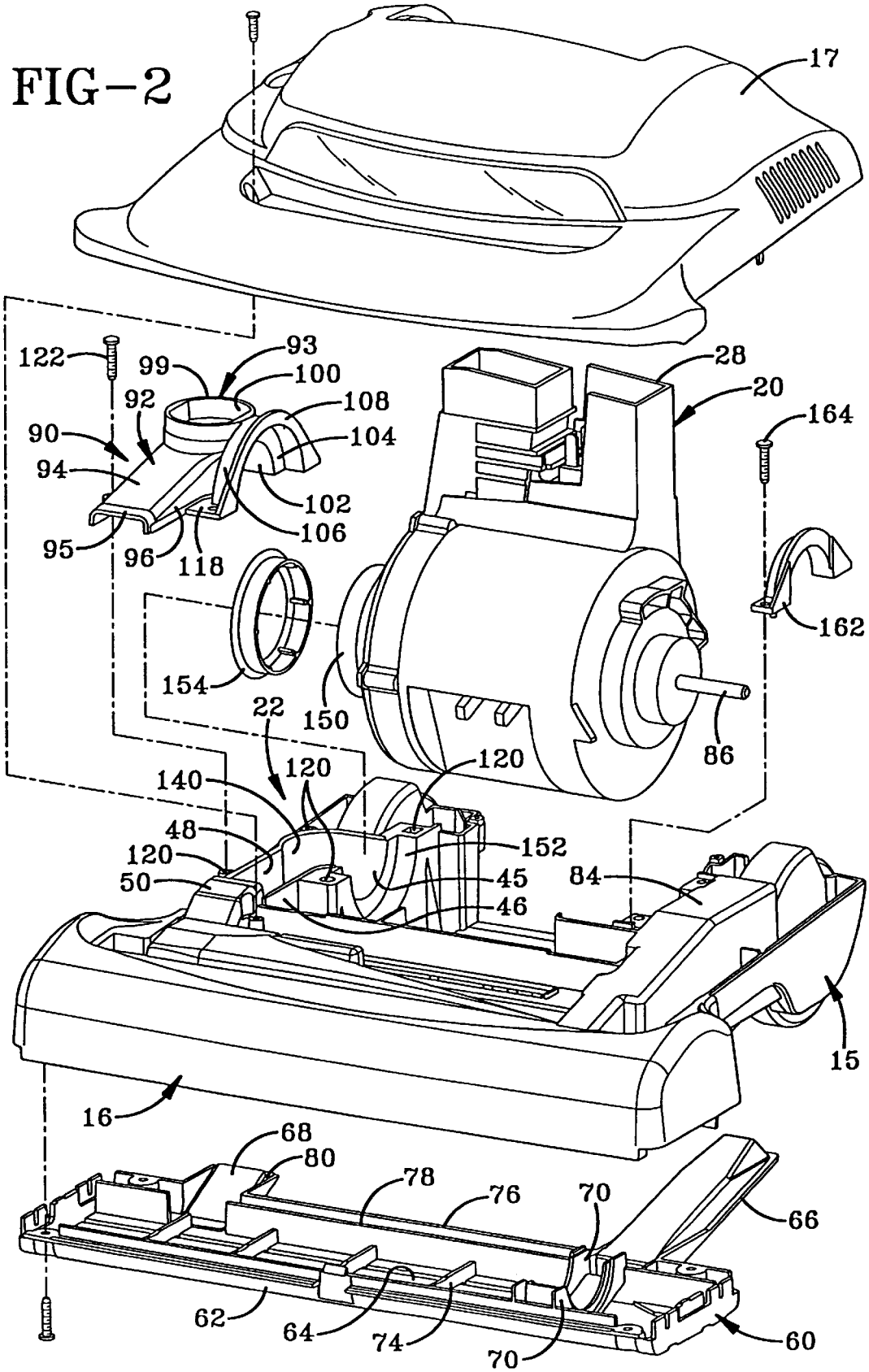
FIG. 2 is an exploded perspective view of the foot of the vacuum cleaner of FIG. 1.
Figure 3:
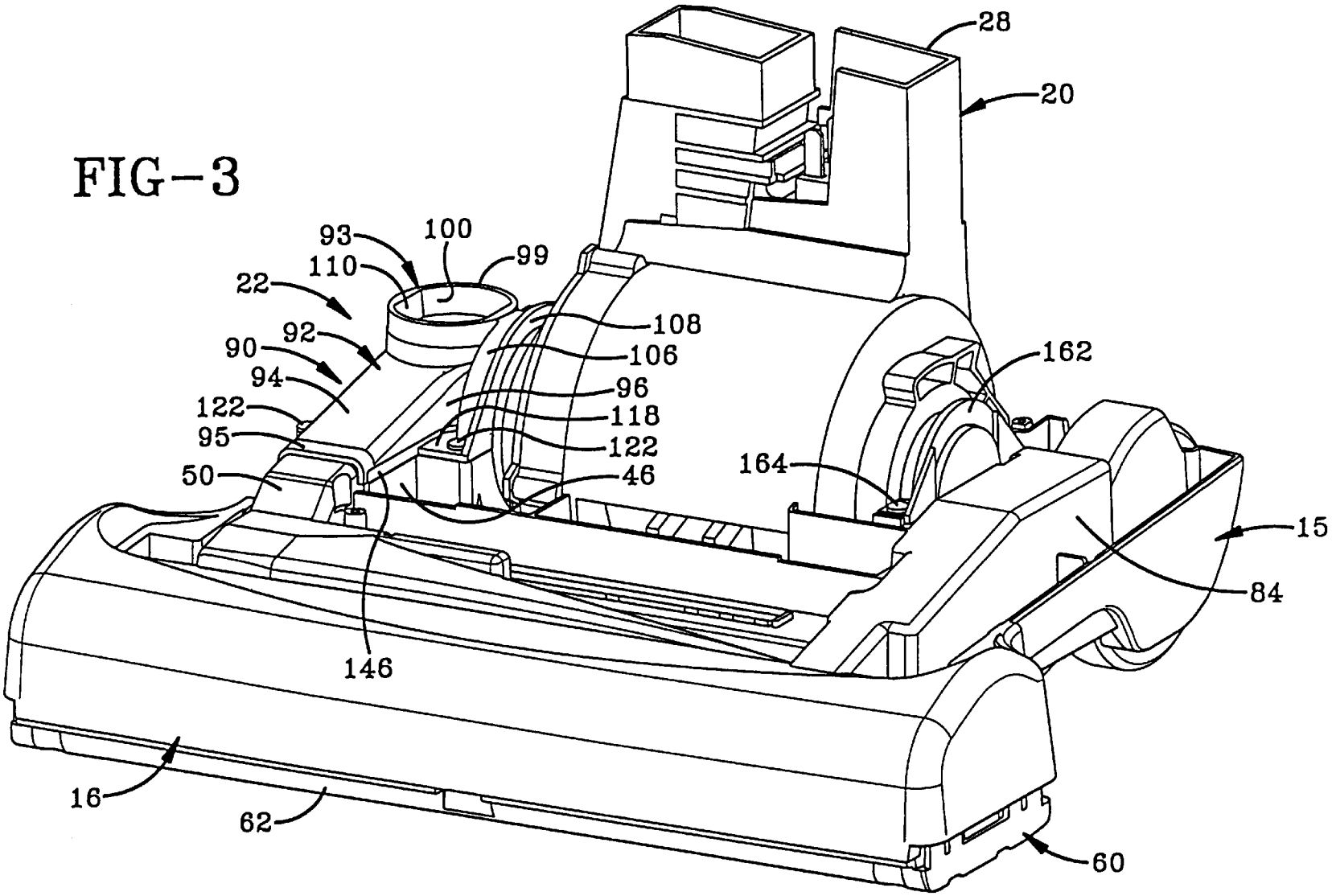
FIG. 3 is an assembled perspective view of the nozzle of FIG. 2 with the hood removed therefrom.
Figure 5:
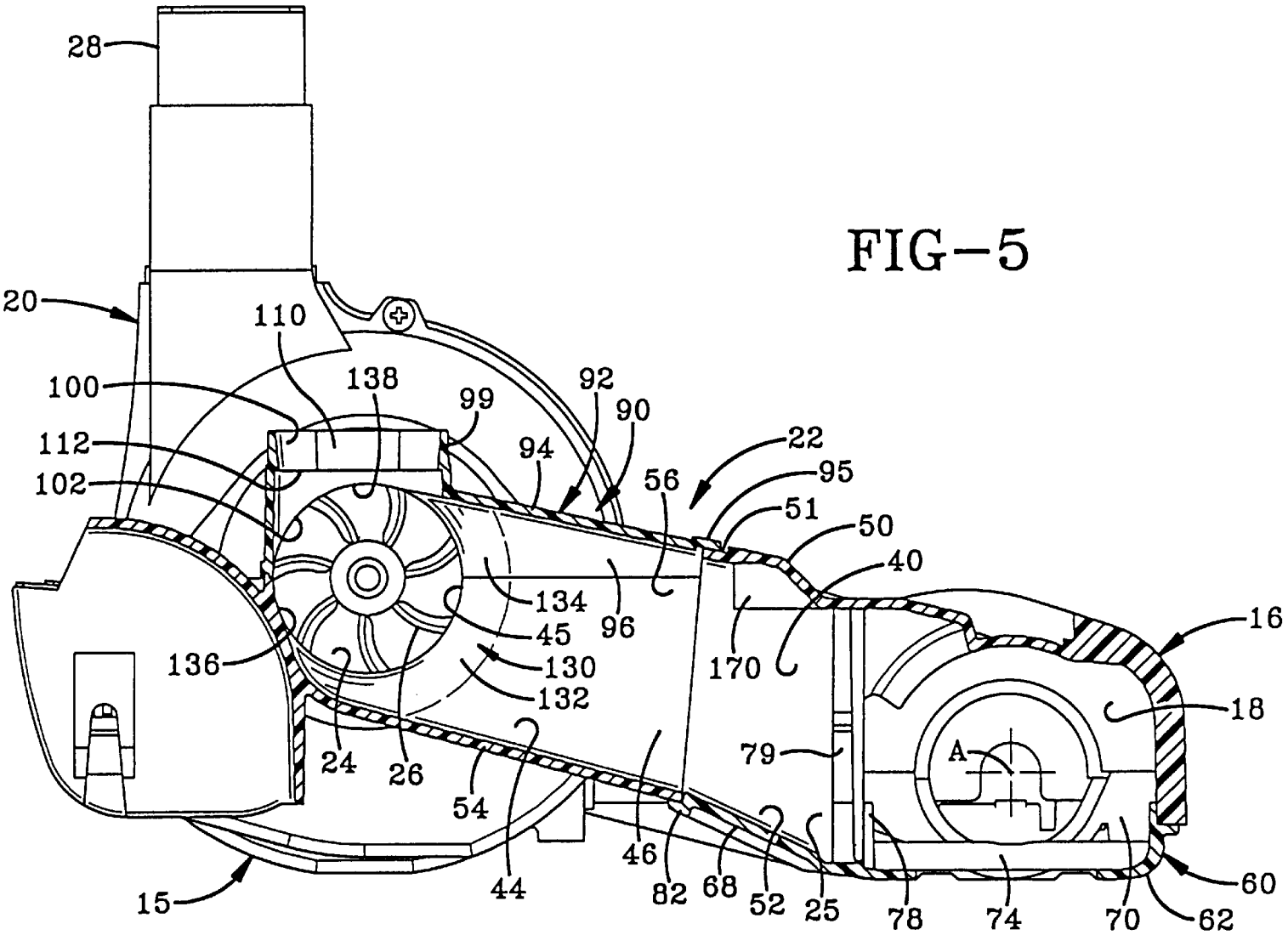
FIG. 5 is a sectional view taken along line 5—5, FIG. 4.
Figure 6:
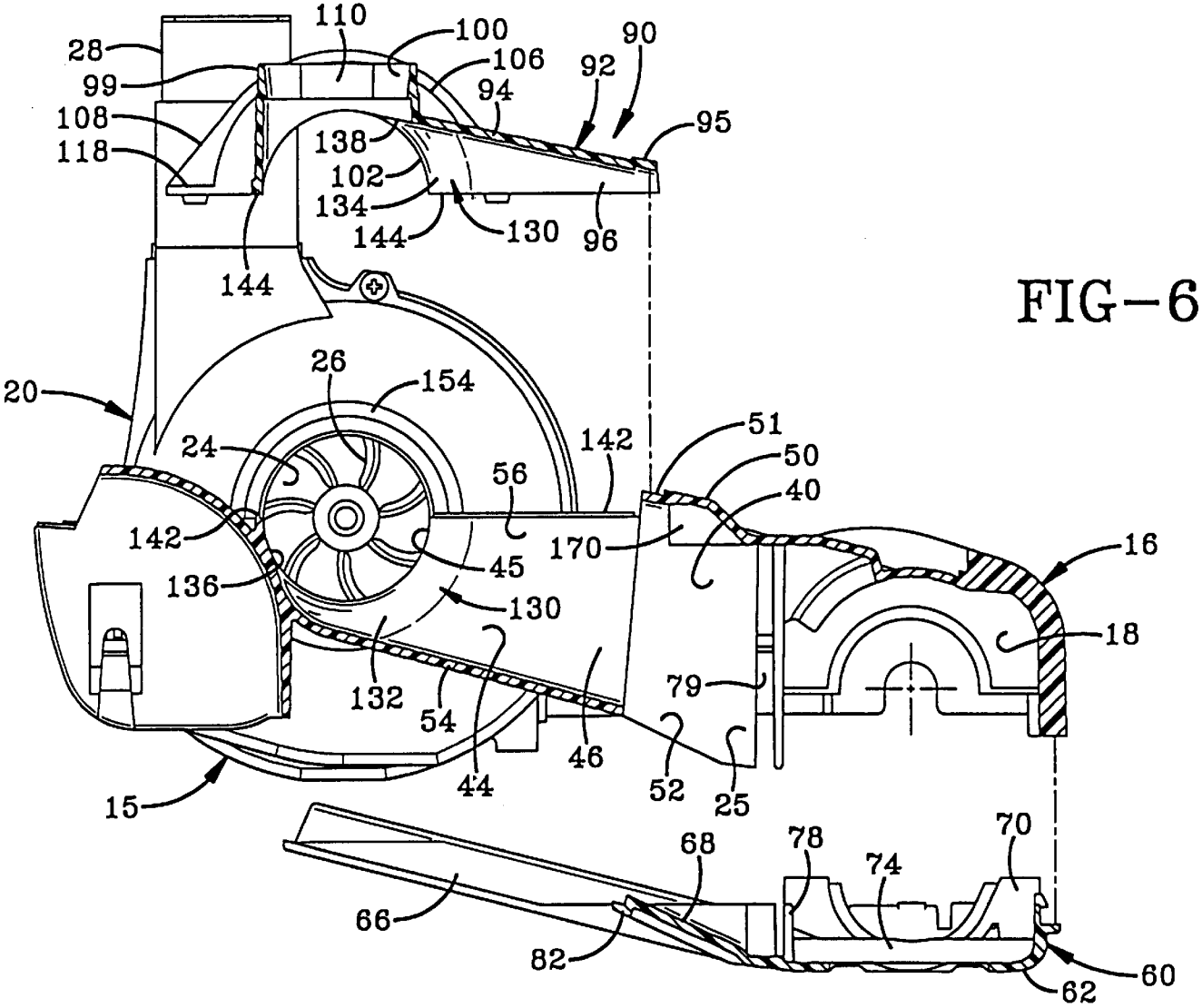
FIG. 6 is a sectional view similar to FIG. 5 showing the bottom plate and top duct cover exploded from the foot.
Figure 7:
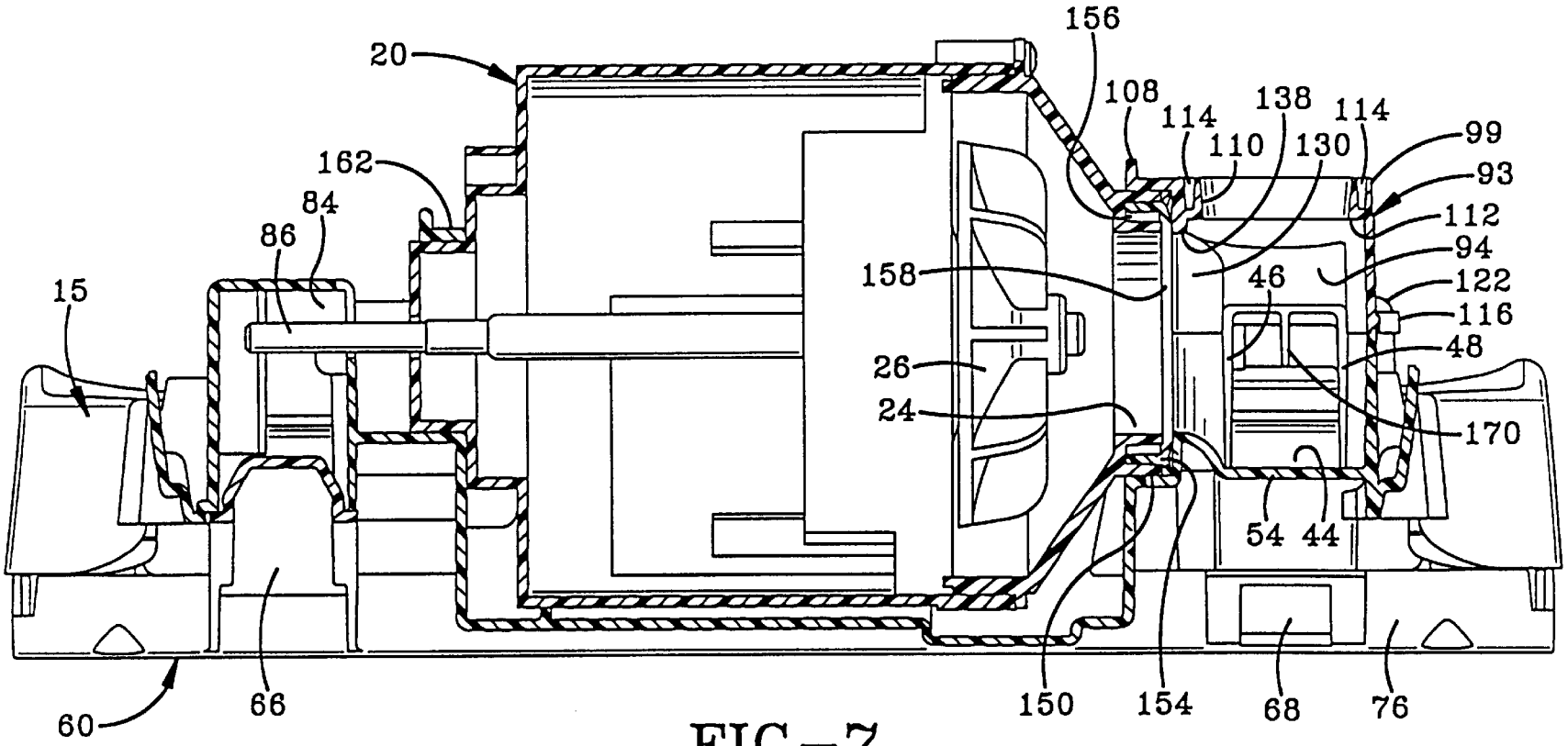
FIG. 7 is a sectional view taken along line 7—7, FIG. 5.

A vacuum cleaner having the dirt conveying duct arrangement of the present invention is shown in FIG. 1 and is indicated at 10. Vacuum cleaner 10 generally includes a foot 12 and an upper handle 14. Foot 12 includes a base 15 (FIGS. 2 and 7), a front nozzle 16 and a hood 17 (FIG. 2). Nozzle 16 is formed with an agitator chamber 18 (FIGS. 5 and 6) and includes a cylindrical agitator (not shown) which rotates about an axis A to agitate or loosen dirt embedded in carpet allowing the dirt to be drawn into agitator chamber 18. A motor-fan 20 (FIG. 2) creates the suction pressure necessary to draw the dirt-laden air from agitator chamber 18 through a dirt conveying duct arrangement 22 and into a motor-fan inlet 24 (FIGS. 5–7). Agitator chamber 18 is formed with an opening 25 in the back wall thereof which forms the mouth or inlet of dirt conveying duct arrangement 22.

Motor-fan 20 includes a fan 26 (FIG. 5) which when rotated creates the suction force necessary to draw the dirt-laden air into motor-fan 20 and blow the dir-laden air out a motor-fan outlet 28. Motor-fan inlet 28 is fluidly connected to a tubular conduit (not shown) of upper handle 14 which allows the dirt-laden air to flow into a filter bag contained within a filter cavity formed in upper handle 14. Upper handle 14 includes a rear bag housing 30 which forms the filter cavity and houses the filter bag along with a removable bag door 32. Upper handle 14 further includes a handle shaft 34 having a handle grip 36 extending angularly therefrom. A front tool storage compartment 38 may be formed in the front of upper handle 14 above the filter bag cavity and bag door 32.

In accordance with one of the main features of the invention, dirt conveying duct arrangement 22 is formed with a front duct section 40 adjacent to and communicating with agitator chamber 18, and a rear duct section 44 extending between front section 40 and motor-fan inlet 24. Rear duct section 44 is formed with a rear opening 45 which allows rear duct section 44 to communicate with motor-fan inlet 24. Front and rear sections 40 and 44, respectively, are formed in foot 12 by an inner side wall 46 and an outer side wall 48 (FIG. 7). Front section 40 is further formed by a top wall 50 formed with an indent 51 (FIG. 6), and has an open bottom 52. Rear section 44 is further formed by a bottom wall 54 and has an open top 56.

Duct arrangement 22 extends transversely across foot 12 generally perpendicular to longitudinally extending axis A of agitator chamber 18 and longitudinally extending motor fan inlet 24. Front duct section 42 is formed with a length of between 1–2 inches, measured from the opening of agitator chamber 18 to the end of top wall 50, and in the preferred embodiment, the length of front duct section 42 is approximately 1 11/16 inches. Rear duct section 44 has a length of between 4–5 inches measured from the end of top wall 50 to the rear wall of the duct, and in the preferred embodiment, the length of rear duct section 44 is approximately 4 1/16 inches.

A bottom plate 60 releasably secures to the bottom of foot 12 and includes a generally rectangular front section 62 (FIG. 2) formed with a central opening 64 through which the bristles of the agitator extend, and through which the dirt-laden air enters agitator chamber 18, a belt compartment cover plate 66 and an angled bottom duct cover 68. Bottom plate 60 extends over the open bottom of agitator chamber 18 and further includes a pair of spaced parallel generally U-shaped walls 70 which form a gap 72 therebetween, and a plurality of ribs 74 which extend transversely across opening 64. A back wall 76 extends along the rear of bottom plate 60 and is interrupted by cover plate 66 and bottom duct cover 68. A second wall 78 is spaced inwardly from and extends parallel to back wall 76 for receiving the bottom portion of a valve assembly (not shown), such as that disclosed in U.S. Pat. No. 5,134,750, assigned to a common assignee and incorporated herein. The valve assembly slides within a passageway 79 (FIGS. 5 and 6) formed between the back wall of the agitator chamber and the front end of inner side wall 46, to open and close duct inlet 25.

As shown in FIG. 6, the front portion of side walls 46 and 48 has an angled bottom end which extends into complementary shaped grooves 80 (FIG. 2) formed in either side of angled bottom duct cover 68 to provide a tongue-and-groove fit between bottom duct cover 68 and duct walls 46 and 48. Bottom duct cover 68 includes an outer lip 82 (FIG. 5) which slightly overlaps the outer surface of bottom wall 54 to limit airflow leaks and losses in the suction pressure within duct arrangement 22. Belt compartment cover plate 66 extends over the usual belt compartment 84 (FIG. 7) which houses the vacuum cleaner belt (not shown) that extends between a motor shaft 86 (FIG. 7) of motor-fan 20 and the agitator.

Figure 4:
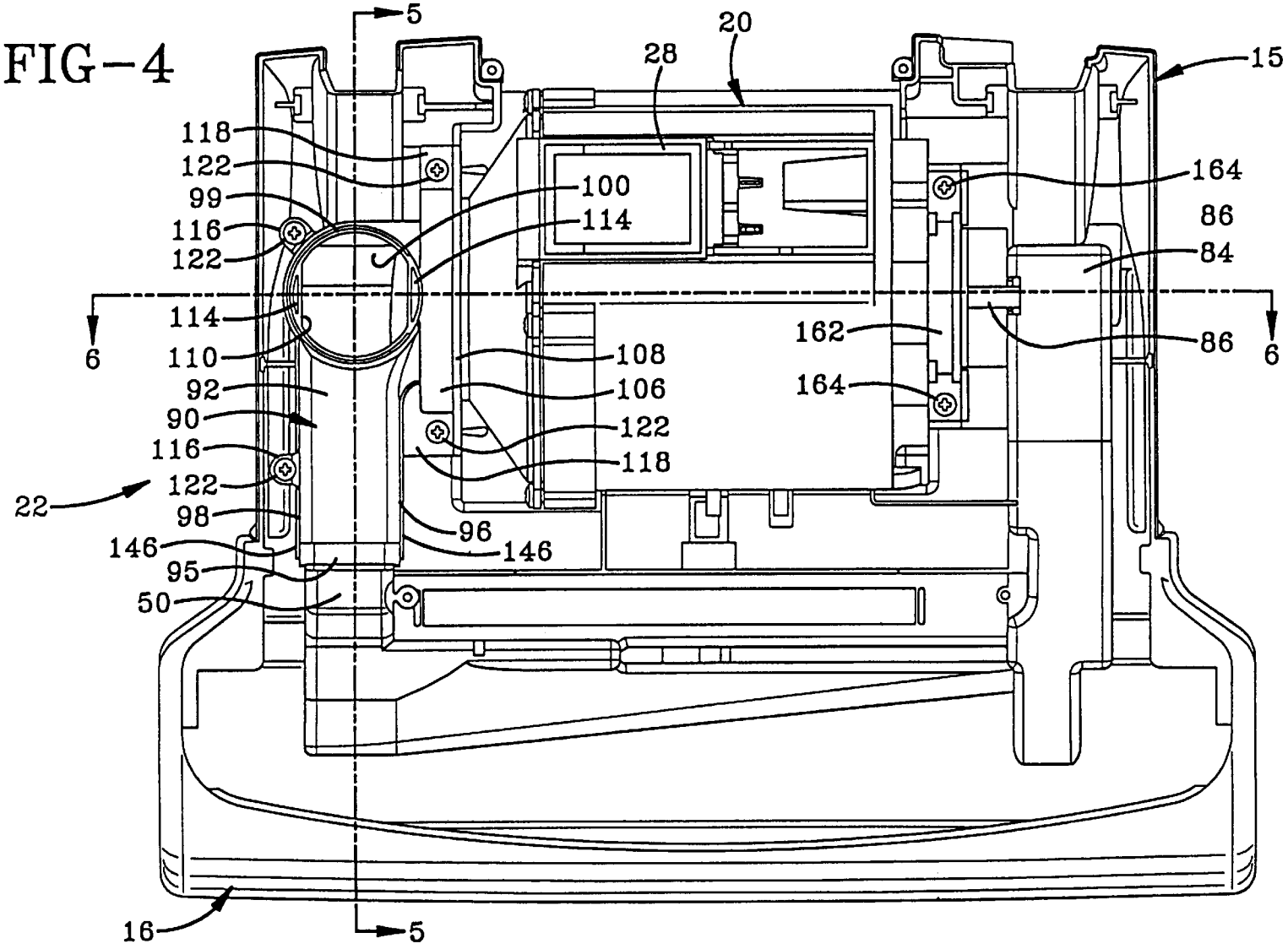
FIG. 4 is a top plan view of the nozzle of FIG. 3.

In accordance with another of the features of the invention, a top duct cover 90 releasably attaches over open top 56 of rear duct section 54. Top duct cover 90 includes angled front portion 92 and a rear cylindrical portion 93. Front portion 92 has a top wall 94, an inner side wall 96 and an outer side wall 98 (FIG. 4). A front tongue 95 (FIG. 6) is formed at the end of front portion 92 and sits within indent 51 to slightly overlap top wall 50 and limit airflow leaks and losses in the suction pressure within duct arrangement 22. Rear portion 93 has a cylindrical wall 99 which forms a cylindrical opening 100, and is formed with a semi-circular side cut-out 102. Cut-out 102 (FIG. 2) is formed by a vertically extending semi-circular side wall 104, an arcuate top wall 106 and an upstanding outer rim 108.

Top cylindrical opening 100 is formed with a pair of diametrically opposed flat walls 110 (FIGS. 3–7) which provide a flat latching shoulder 112 for receiving the barbed tabs (not shown) of a hose connector 113 (FIG. 1). Hose connector 113 extends through an opening formed in hood 17 and is received within opening 100 for semi-permanently connecting an attachment hose 115 of vacuum cleaner 10 to the suction pressure produced by motor-fan 20. A slot 114 is formed between flat walls 110 and cylindrical wall 99 which reduces sinkage during the molding of top duct cover 90. A pair of lugs 116 (FIG. 4) extend outwardly from side wall 98 of top duct cover 90, and a pair of horizontal plates 118 extend outwardly from each side of cut-out 102. Lugs 116 and plates 118 are formed with circular holes which align with complementary shaped bosses 120 (FIG. 2) on foot 12 and receive screws 122 for releasably securing top duct cover 90 over open top 56 of rear duct section 44.

In accordance with another of the features of the invention, by forming rear duct section 44 with open top 56, rear opening 45 may be formed with a radiused or curved corner 130 (FIGS. 5–7). Radiused corner 130 has a radius of curvature of between 0.40 and 0.50 inches and in the preferred embodiment has a radius of curvature of approximately 0.47 inches. A lower portion 132 of radiused corner 130 is formed in inner side wall 46 and has a generally semi-circular shape. Lower portion 132 of radiused corner 130 is curved at the front and bottom thereof with the rear bottom portion tapering into a flat rear wall 136. An upper portion of radiused corner 130 is formed by inner side wall 96 of top duct cover 90 and extends between the inner side wall and semi-circular side wall 104. Upper portion 134 of radiused corner 130 is curved at the front thereof and tapers into an arcuate top wall 138. Radiused comer 130 prevents losses which typically occur when the direction of a fluid or airflow changes by 90 degrees.

Outer side wall 48 of duct arrangement 22 is formed with an enlarged rear comer 140 (FIG. 2) which aligns with a corresponding portion of cylindrical wall 99 of top duct cover 90. Side walls 46 and 48 of duct 22 are formed with an upstanding ridge 142 (FIG. 6) which abuts a bottom edge 144 of side walls 96 and 98 when top duct cover 90 is assembled over open top 56. Side walls 96 and 98 are formed with an outwardly offset lip 146 around the bottom peripheral edge thereof. Lip 146 overlaps ridge 142 to further limit airflow leaks and losses in the suction pressure within duct arrangement 22.

Motor-fan inlet 24 is formed by an outwardly extending cylindrical collar 150 (FIG. 7) which sits on an enlarged stepped portion 152 formed in base 15 adjacent rear opening 45 of rear duct section 44. A seal 154 extends within a circular groove 156 formed in collar 150 to seal a tolerance gap 158 formed between motor-fan 20 and base 15 during the manufacturing of foot 12. Motor-fan 20 is held within base 15 by arcuate top wall 106 which extends over the top portion of cylindrical collar 150, and a semi-circular bracket 162 which extends over the top portion of the shaft end of motor-fan 20 and is secured with screws 164.

A small fin 170 (FIGS. 5 and 6) extends downwardly from top wall 50 into front duct section 40 to partially obstruct a portion of said front duct section and prevent large objects from entering duct arrangement 22 and possibly damaging fan 26. Side walls 46 and 48 of front duct section 40 are tapered outwardly from the top to the bottom thereof, while side walls 46 and 48 of rear duct section 44 are tapered outwardly from the bottom to the top thereof, allowing respective portions of a mold to extend within open bottom 52 and open top 56 to form duct sections 40 and 44, respectively. Tapered side walls 46 and 48 allow the portions of the mold to be easily released from base 15 and prevent any sliding or pulling of the plastic material when the base is removed from the mold.

In the assembled position, bottom plate 60 is fastened to the bottom of base 15 with the front rectangular section 62 extending over the bottom opening of agitator chamber 18. Cover plate 66 extends over belt compartment 84 to prevent access to the moving motor shaft and belt, and duct cover 68 extends over open bottom 52 of front duct section 40.

As described above, the angled bottom edge of duct walls 46 and 48 extend within grooves 80, and outer lip 82 of bottom duct cover 68 slightly overlaps bottom wall 54 to limit airflow leaks and pressure losses in the covered open bottom 52. Top duct cover 90 is positioned over open top 56 of rear duct section 44 whereby peripheral lip 146 of duct cover 90 extends over ridge 142 of side walls 46 and 48, and tongue 95 resting within indent 51 slightly overlapping top wall 50.

As shown in FIG. 6 bottom plate 60 is removed from base 15 to change the belt within belt compartment 84 or to remove a clog within front duct section 40. With the bottom plate removed from base 15, open front duct section 40 provides visibility to rear duct section 44 allowing clogs within the rear duct section to be detected by the user. To gain access to rear duct section 44, the user must first remove hood 17 from base 15 then unscrew screws 22. Top duct cover 90 is then removed from base 15 providing access to clogs within rear duct section 44 and to service the motor.

In use, dirt-laden air is loosened from a carpet or floor surface by the agitator rotating about axis A and is drawn into agitator chamber 18. Motor-fan 20 rotates fan 26 producing a suction pressure within duct 22 and agitator chamber 18 which draws the dirt-laden air from agitator 18, through inlet 25 and into front duct section 40. The dirt-laden air flows from front duct section 40 into rear duct section 44. The airflow will be drawn along radiused corner 130, through rear opening 45 and into motor-fan inlet 24. The airflow is then blown out motor-fan outlet 28 and into the filter bag as described above. Radiused corner 130 reduces losses and dead air space which typically occur when an airflow is directed around a 90 degree angle, thus improving the suction pressure within duct 22 and agitator 18 and improving the airflow into motor-fan inlet 24. When the valve assembly of U.S. Pat. No. 5,134,750 is closed, the suction pressure is redirected to hose attachment 113 creating a suction pressure at the end of hose 115 for above-the-floor cleaning of, for example, stairs and furniture.

Accordingly, the dirt conveying duct arrangement is simplified, provides an effective, safe, inexpensive, and efficient device which achieves all of the enumerated objectives, provides for eliminating difficulties encountered with prior devices, and solves problems and obtains new results in the art.

In the foregoing description, certain terms have been used for brevity, clearness and understanding; but no unnecessary limitations are to implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and the principles of the invention, the manner in which the improved dirt conveying duct arrangement is constructed and used, the characteristics of the construction, and the advantageous, new and useful results obtained; the new and useful structures, devices, elements, arrangements, parts and combinations are set forth in the appended claims.

We claim:

1. A vacuum cleaner foot which includes a base and a motor-fan attached to the base and formed with a motor-fan inlet, said base having a top, a bottom and a nozzle portion formed with an agitator chamber, the improvement comprising:

a dirt conveying duct arrangement formed in the foot for fluidly connecting the agitator chamber with the motor-fan inlet, said dirt conveying duct arrangement including:

a front duct section formed in the base by a top wall, an inner side wall, an outer side wall, and a removable bottom wall, said front duct section communicating with the agitator chamber; and a rear duct section formed in the base by a bottom wall and the inner and outer side walls, and a removable top wall, said rear duct section communicating with the front duct section and with the motor fan inlet.

2. The improvement as defined in claim 1 wherein the removable bottom wall is a bottom plate removably connected to the bottom of the base for covering the open bottom of the front duct section.

3. The improvement as defined in claim 2 wherein the removable top wall is a top duct cover removable connected to the top of the base for covering the open top of the rear duct section.

4. The improvement as defined in claim 3 in which the top duct cover includes a rear portion formed with an opening for connecting an attachment hose to the motor-fan inlet.

5. The improvement as defined in claim 1 in which the motor extends longitudinally across the foot; in which the front and rear duct sections extend transversely across the foot; and in which a corner is formed between the inner side wall and motor fan inlet.

6. The improvement as defined in claim 5 in which the angled corner is formed with a curved radius.

7. The foot as defined in claim 6 in which an upper portion of the radiused corner is formed in the top duct cover and a lower portion of the radiused corner is formed in the base.

8. The improvement as defined in claim 6 in which the corner has a radius of curvature of between 0.40 and 0.50 inches.

9. The improvement as defined in claim 1 in which the rear duct section has a length which is greater than a length of the front duct section.

10. The improvement as defined in claim 9 in which the rear duct section has a length of between 4–5 inches; and in which the front duct section has a length of between 1–2 inches.

11. The improvement as defined in claim 1 further including a fin extending downwardly into the front duct section from the top wall to partially obstruct a portion of said front duct section.

12. The improvement as defined in claim 1 further including a hood removably attached to the base whereby said hood prevents the removal of the top duct cover while the hood is attached to the base.

13. A vacuum cleaner foot including:

a base having a top and a bottom;

an agitator chamber formed in the base;

a motor-fan attached to the base for producing a suction force within the agitator chamber, said motor fan being formed with a motor-fan inlet;

a front duct section formed in the base and communicating with the agitator chamber, said front duct section having an open bottom;

a rear duct section formed in the base and communicating with the front duct section and the motor fan inlet, said rear duct section having an open top;

a bottom plate removably attached to the bottom of the base to cover the open bottom of the front duct section;

a top duct cover removably attached to the top of the base to cover the open top of the rear duct section; and a hood removably attached to the top of the base and extending over the top duct cover whereby said hood prevents the removal of the top duct cover while the hood is attached to the base.

14. The foot as defined in claim 13 in which the top duct cover is formed with a top opening for receiving an attachment hose connector.

15. The foot as defined in claim 14 in which the hood is formed with an opening for allowing the attachment hose connector to extend therethrough to the top duct cover.

16. The foot as defined in claim 13 in which an opening is formed in the base which provides for fluid communication between the rear duct section and the motor-fan inlet.

17. The foot as defined in claim 16 in which a radiused corner is formed between the rear duct section and the motor fan inlet.

18. The foot as defined in claim 17 in which an upper portion of the radiused corner is formed in the top duct cover and a lower portion of the radiused corner is formed in the base.

19. The foot as defined in claim 13 in which an arcuate wall of the top duct cover extends over a portion of the motor-fan to retain said portion of the motor-fan on the base.

20. A top duct cover for covering a portion of a dirt conveying duct formed in a vacuum cleaner foot, said vacuum cleaner foot having a base and a motor-fan formed with a motor-fan inlet and attached to the base, said top duct cover including:

a generally U-shaped front portion having a top wall, and a pair of side walls formed integrally with the top wall; and a rear portion having a cylindrical wall which extends upwardly from the top wall of the front portion and forms a cylindrical opening for receiving a hose connector, and which is formed with a side cut-out which communicates with the motor-fan inlet.

* * * * *